United States Patent [19]

Mangrobang et al.

[11] 4,329,537

[45] May 11, 1982

[54] CRIMP-TYPE CABLE SHIELD BONDING DEVICE

[75] Inventors: Maurice G. Mangrobang, Culver City; Charles W. Waas, Huntington Beach, both of Calif.

[73] Assignee: Communications Technology Corporation, Los Angeles, Calif.

[21] Appl. No.: 66,780

[22] Filed: Aug. 14, 1979

[51] Int. Cl.[3] ..... H01R 4/18

[52] U.S. Cl. ..... 174/84 C; 174/75 C; 174/88 C

[58] Field of Search ..... 174/75 C, 78, 84 C, 174/88 R, 88 C; 339/95 R, 13, 14 R, 14 L

[56] References Cited

FOREIGN PATENT DOCUMENTS 2202789 7/1973 Fed. Rep. of Germany .... 339/95 R
2203946 8/1973 Fed. Rep. of Germany .... 339/95 R

*Primary Examiner*—Roy N. Envall, Jr.

[57] ABSTRACT

A crimp-type cable shield bonding device for electrically interconnecting the shields of two sheathed and shielded cables each having an outer protective sheath and an underlying shield which enclose a bundle of conductors. The bonding device includes two tubular clamps respectively connectible to adjacent ends of the two cables. Each tubular clamp comprises a generally semicylindrical outer portion adapted to fit over the outer protective sheath at one end of one of the cables and a generally V-shaped inner portion within such outer portion, with its apex extending toward the outer portion. The inner portion of each tubular clamp is insertable between the shield and the conductors at the corresponding end of the corresponding cable with its apex extending toward the shield. The inner portion of each tubular clamp has teeth extending toward the outer portion of such tubular clamp and adapted to penetrate the shield of the corresponding cable. An electrically conductive member is connected at its ends to the two tubular clamps to establish the desired electrical interconnection between the two cable shields.

3 Claims, 7 Drawing Figures

CRIMP-TYPE CABLE SHIELD BONDING DEVICE

BACKGROUND OF INVENTION

The present invention relates in general to cable shield bonding devices for electrically interconnecting the shields of two sheathed and shielded cables each having an outer protective sheath and an underlying shield which enclose a bundle of connectors.

Generally relevant prior art includes U.S. Pat. Nos. 3,915,540 and 3,963,299, respectively issued Oct. 28, 1975 and June 15, 1976, both to John T. Thompson and George W. Gillemot.

OBJECTS AND SUMMARY OF INVENTION

The invention may be summarized as including, and a primary object thereof is to provide, a crimp-type cable shield bonding device including an electrically conductive member having connected to the ends thereof tubular clamps adapted to be crimped over adjacent ends of two sheathed and shielded cables, in electrical contact with the shields thereof.

More particularly, an important object is to provide a tubular clamp for the foregoing purpose comprising a generally semi-cylindrical outer portion adapted to fit over the outer protective sheath at one end of the corresponding cable and a generally V-shaped inner portion within the outer portion, with its apex extending toward the outer portion, the inner portion of each tubular clamp being insertable between the shield and the conductors at the end of the corresponding cable with its apex extending toward the shield.

Another important object is to provide the inner portion of each tubular clamp with means for gripping the shield of the corresponding cable.

Still another object is to provide each tubular clamp with a gripping means comprising teeth on the inner portion of the tubular clamp extending toward the outer portion thereof, and adapted to penetrate the shield of the corresponding cable.

The foregoing structure provides a simple and effective means for electrically interconnecting the shields of two sheathed and shielded cables, using only a simple tool, such as a pair of pliers. The tubular configuration of the clamps minimizes springback after crimping, which is an important feature.

The foregoing objects, advantages, features and results of the present invention, together with various other objects, advantages, features and results thereof which will be evident to those skilled in the cable shield bonding art in the light of this disclosure, may be achieved with the exemplary embodiments of the invention illustrated in the accompanying drawing and described in detail herinafter.

DETAILED DESCRIPTION OF EXEMPLARY EMBODIMENTS OF INVENTION

Figure 1:
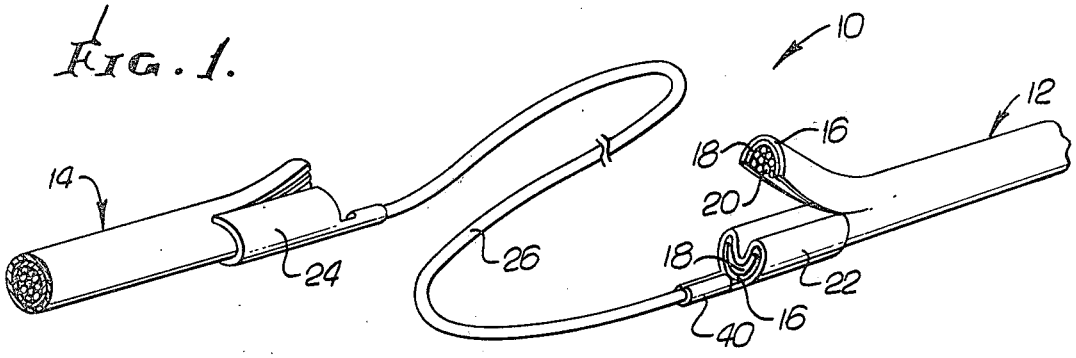
FIG. 1 is a perspective view of a crimp-type cable shield bonding device of the invention as installed on adjacent ends of two sheathed and shielded cables to electrically interconnect the shields of such cables, the cable ends being shown with portions thereof spread apart to better illustrate the manner in which the bonding device is connected thereto.

Referring initially to FIG. 1 of the drawing, the crimp-type cable shield bonding device of the invention is designated generally by the numeral 10 and electrically interconnects the shields of two sheathed and shielded cables 12 and 14. More particularly, the cable 12 includes an outer protective sheath 16 and an underlying electrically conductive shield 18 which enclose a conductor bundle 20. The cable 14 has a similar construction. The bonding device 10 electrically interconnects the shield 18 of the cable 12 and the corresponding shield, not shown, of the cable 14.

The bonding device 10 includes two tubular clamps 22 and 24 respectively connectible to adjacent ends of the cables 12 and 14, the two clamps being electrically interconnected by an electrically conductive member 26. The two tubular clamps 22 and 24 are identical and only the clamp 22 will be described.

Figure 2:
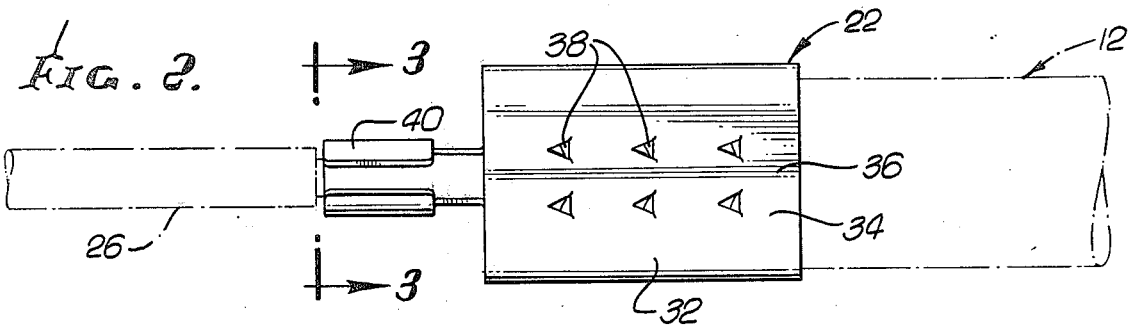
FIG. 2 is an elevational view showing the inner side of a tubular clamp forming part of the bonding device of FIG. 1.
Figure 4:
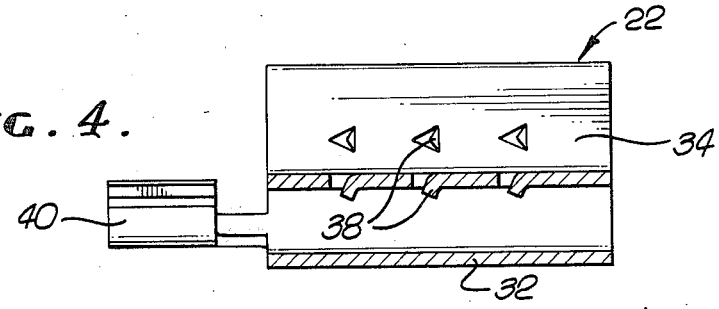
FIG. 4 is a longitudinal sectional view taken as indicated by the arrowed line 4—4 of FIG. 3.
Figure 3:
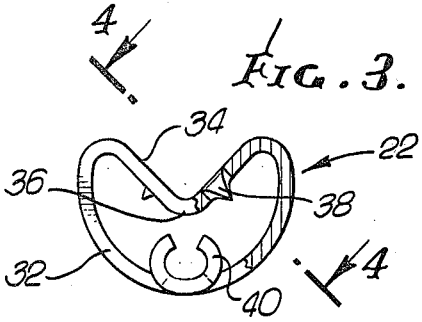
FIG. 3 is an end view, partially in section, taken as shown by the arrowed line 3—3 of FIG. 2.

The tubular clamp 22, as best shown in FIGS. 2 to 4, comprises a generally semi-cylindrical outer portion 32 adapted to fit over the outer protective sheath at one end of the cable 12, as will be clear from FIG. 1. The tubular clamp 22 further includes a generally V-shaped inner portion 34 within the outer portion 32, with its apex 36 extending toward the outer portion, as will be clear from FIG. 3. The inner portion 34 of the tubular clamp 22 is insertable between the shield 18 and the conductors of the cable 12, at the corresponding end of such cable, with its apex 36 extending toward the shield. It will be understood that the inner portion 34 of the tubular clamp 22 is inserted between the shield 18 and the conductor bundle 20.

The inner portion 34 of the tubular clamp 22 is provided with means for gripping the shield 18 of the cable 12 in good electrical contact therewith. More particularly, the gripping means is shown as including two rows of teeth 38 struck from the inner portion 34 of the tubular clamp 22 and extending outwardly toward the outer portion 32 of such tubular clamp, and toward the outer end thereof, i.e., toward the end thereof which is nearest the cable end. These teeth 38 are adapted to penetrate the shield 18 of the cable 12 to obtain a good electrical connection, and to mechanically hold the tubular clamp 22 on the end of the corresponding cable 12.

The tubular clamp 22 may be installed on the end of the cable 12 by inserting it in the manner hereinbefore outlined, and then crimping the tubular clamp onto the cable end, using only a simple tool, such as a pair of pliers. The tubular configuration of the clamp 22 minimizes springback after crimping, which is an important feature.

In the embodiment illustrated in FIGS. 1 to 4 of the drawings, the outer portion 32 of the tubular clamp 22 has at its outer end a split tubular extension 40 adapted to be crimped onto the corresponding end of the electrically conductive member 26. As will be apparent, it is merely necessary to insert one end of the electrically conductive member 26 into the split tubular extension 40, and then crimp the latter onto the conductive member, again using only a pair of pliers, or the equivalent.

Figure 5:
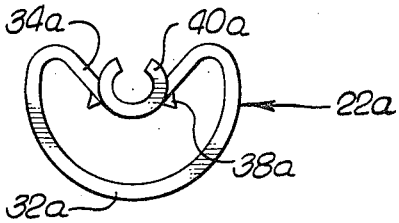
FIG. 5 is an end view similar to FIG. 3, but showing an alternative embodiment.

FIG. 5 of the drawing shows a similar tubular clamp 22*a* having similar outer and inner portions 32*a* and 34*a*, the latter being provided with similar teeth 38*a*. In this case, the split tubular extension 40*a* is formed integrally with the inner portion 34*a*, rather than the outer portion 32*a*. In all other respects, the structure and installation of the tubular clamp 22*a* are the same as those of the tubular clamp 22.

Figure 6:
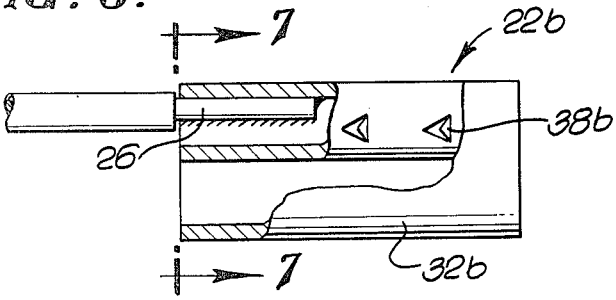
FIG. 6 is an elevational view, partially in longitudinal section, illustrating still another embodiment of the invention.
Figure 7:
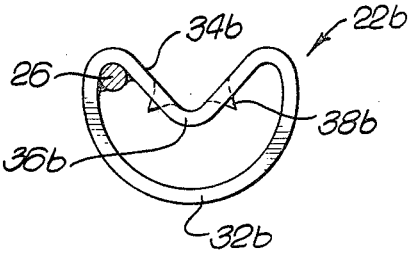
FIG. 7 is an end view, partially in transverse section, taken as indicated by the arrowed line 7—7 of FIG. 6.

FIGS. 6 and 7 of the drawing illustrate another embodiment of the invention comprising a tubular clamp 22*b* which includes an outer portion 32*b*, an inner portion 34*b* with an apex 36*b*, and teeth 38*b* on the inner portion 34*b*, these components respectively corresponding to the outer portion 32, the inner portion 34, the apex 36 and the teeth 38 of the tubular clamp 22. In this case, the corresponding end of the electrically conductive member 26 is brazed, soldered, welded, or the like, into one of the internal corners formed by the junction of the outer and inner portions 32*b* and 34*b*, as will be clear from FIG. 7 in particular.

Although exemplary embodiments of the invention have been disclosed for purposes of illustration, it will be understood that various minor changes, modifications and substitutions may be incorporated in such embodiments without departing from the invention as hereinafter claimed.

We claim as our invention:

1. In a crimp-type cable shield bonding device for electrical connection to the shield of a sheathed and shielded cable having an outer protective sheath and an underlying shield which enclose a bundle of conductors, the combination of:

a tubular clamp comprising a generally semi-cylindrical outer portion adapted to fit over the outer protective sheath at one end of the cable and a generally V-shaped inner portion within said outer portion, with its apex extending toward said outer portion, said inner portion being insertable between the shield and the conductors at said end of the cable with its apex extending toward the shield, with said outer and inner portions formed integrally with each other forming a sleeve for slidingly receiving a portion of the cable sheath and shield;

said inner portion of said tubular clamp having means for gripping the shield of the cable when said clamp is crimped onto the cable; and means for securing an electrically conductive member to said tubular clamp.

2. In a crimp-type cable shield bonding device for electrical connection to the shield of a sheathed and shielded cable having an outer protective sheath and an underlying shield which enclose a bundle of conductors, the combination of:

a tubular clamp comprising a generally semi-cylindrical outer portion adapted to fit over the outer protective sheath at one end of the cable and a generally V-shaped inner portion within said outer portion, with its apex extending toward said outer portion, said inner portion being insertable between the shield and the conductors at said end of the cable with its apex extending toward the shield, with said outer and inner portions formed integrally with each other forming a sleeve for slidingly receiving a portion of the cable sheath and shield;

said inner portion of said tubular clamp having teeth extending toward said outer portion of said tubular clamp and adapted to penetrate the shield of the cable when said clamp is crimped onto the cable; and means for securing an electrically conductive member to said tubular clamp.

3. A crimp-type cable shield bonding device as defined in claim 2 including two of said tubular clamps respectively connected to the ends of said electrically conductive member, with said clamps respectively connectible to ends of two sheathed and shielded cables in the manner set forth in claim 2.

* * * * *